US006248055B1

(12) United States Patent
Ostkamp

(10) Patent No.: US 6,248,055 B1
(45) Date of Patent: Jun. 19, 2001

(54) HOUSING STRUCTURE FOR USE IN A HORIZONTAL SOLID-BOWL SCREW DECANTER CENTRIFUGE

(75) Inventor: Wilhelm Ostkamp, Oelde (DE)

(73) Assignee: Westfalia Separator AG, Oelde (DE)

( * ) Notice: Subject to any disclaimer, the term of this patent is extended or adjusted under 35 U.S.C. 154(b) by 0 days.

(21) Appl. No.: 09/332,686

(22) Filed: Jun. 14, 1999

Related U.S. Application Data

(63) Continuation of application No. PCT/EP98/00733, filed on Feb. 10, 1998.

(30) Foreign Application Priority Data

Apr. 1, 1997 (DE) ..... 197 13 512

(51) Int. Cl.[7] ..... B04B 7/02
(52) U.S. Cl. ..... 494/60
(58) Field of Search ..... 494/12, 31, 50–54, 494/60, 64, 85, 37; 210/360.1, 380.1, 380.3, 232

(56) References Cited

U.S. PATENT DOCUMENTS

| | | | | |
|---|---|---|---|---|
| 2,949,045 | | 8/1960 | Rushing . | |
| 3,096,282 | * | 7/1963 | Trotter, Jr. | 494/53 |
| 3,398,888 | * | 8/1968 | Koenecke et al. | 494/53 |
| 3,474,955 | * | 10/1969 | Lang et al. | 494/60 |
| 4,120,447 | * | 10/1978 | Jager | 494/60 |
| 4,251,023 | | 2/1981 | Hohne et al. . | |
| 4,335,846 | * | 6/1982 | Shapiro | 494/60 |

FOREIGN PATENT DOCUMENTS

| | | | |
|---|---|---|---|
| 36 12 919 | | 10/1987 | (DE) . |
| 43 15 694 A1 | | 11/1994 | (DE) . |
| 0 638 521 | | 2/1995 | (EP) . |
| 2100625 | * | 1/1983 | (GB) ..... 494/53 |

* cited by examiner

*Primary Examiner*—Charles E. Cooley
(74) *Attorney, Agent, or Firm*—Henry M. Feiereisen; Ursula B. Day

(57) ABSTRACT

A housing structure adapted for use in a horizontal solid-bowl screw decanter centrifuge, includes an outer housing body having a bottom area formed with an assembly opening which extends over a substantial length of the housing body and is destined for insertion of a tubular inner bowl. The inner bowl is secured to the housing body at opposite end faces of the housing body and is formed for discharge of solids and liquids with connection ports which extend radially with respect to an axis of rotation of the centrifuge. The outer housing body has opposite axial ends formed with access openings for insertion of a rotor and a transmission into the interior space of the inner bowl.

1 Claim, 2 Drawing Sheets

HOUSING STRUCTURE FOR USE IN A HORIZONTAL SOLID-BOWL SCREW DECANTER CENTRIFUGE

CROSS-REFERENCES TO RELATED APPLICATIONS

This application is a continuation of prior filed copending PCT International application no. PCT/EP98/00733, filed Feb. 10, 1998. This application also claims the priority of German Patent Application Serial No. 197 13 512.9, filed Apr. 1, 1997, the subject matter of which is incorporated herein by reference.

BACKGROUND OF THE INVENTION

The present invention relates to a housing structure for use in a horizontal solid-bowl screw decanter centrifuge.

German Pat. No. 43 15 694 A1 describes a housing for a horizontal solid-bowl screw decanter centrifuge in which the housing is parted along the horizontal plane extending through the rotation axis of the centrifuge, with the housing parts being secured by a flanged connection. This construction experiences significant problems in connection with sealing the partition line between the housing parts.

SUMMARY OF THE INVENTION

It is thus an object of the present invention to provide an improved housing structure for use in a horizontal solid-bowl screw decanter centrifuge, obviating the afore-stated drawbacks.

In particular, it is an object of the present invention to provide an improved housing structure for use in a horizontal solid-bowl screw decanter centrifuge, which is formed of two parts and yet is simple to construct and reliable in operation.

It is still another object of the present invention to provide an improved decanter centrifuge incorporating a housing structure according to the present invention, and providing a method for assembling the novel and inventive decanter centrifuge.

These objects, and others which will become apparent hereinafter, are attained in accordance with the present invention by providing an outer housing body having a bottom area formed with an assembly opening which extends over a substantial length of the housing body and is destined for insertion of a tubular inner bowl which is secured to the housing body at opposite end faces of the housing body, wherein the inner bowl has an interior space and is formed for discharge of solids and liquids with connection ports which extend radially with respect to an axis of rotation of the centrifuge, and wherein the outer housing body has opposite axial ends formed with openings for insertion of a rotor and a transmission into the interior space of the inner bowl.

The provision of two bowl-shaped members, i.e. outer housing body and inner bowl, the housing structure can be best suited to the application at hand, whereby suitable tasks can be assigned to the housing body and the inner bowl. The outer housing body may be made in one piece from cast iron, thereby realizing a high structural strength in a simple manner while attaining superior machine dynamics.

The tubular inner bowl may be simply made form a material that is best suited to the product treated in the centrifuge. The outer surface of the inner bowl does not constitute a surface that comes into contact with the product and, moreover, is not visible from outside so that the outer welding seams can be made in a simple manner, with little regard to quality.

A further advantage of designing the housing structure in the form of two bowls resides in the significantly reduced noise emission.

According to another feature of the present invention, the tubular inner bowl is inserted through the lower assembly opening into the outer housing body such that during installation the longitudinal axis of the inner bowl extends parallel to the longitudinal axis of the outer housing body. As soon as the longitudinal axes of the outer housing body and the tubular inner bowl coincide, the inner bowl is moved in axial direction to one end face of the outer housing body for attachment of the inner bowl to the outer housing body, for example by screws. An inner ring inserted into the interior of the inner bowl is bolted to the other end face of the outer housing body after securement on this end face at the outer housing body, so that the end face of the inner bowl is supported by this inner ring, and the inner bowl can execute a compensating movement with respect to the inner ring when subject to different temperatures.

The rotor and the transmission of the centrifuge are inserted into the inner bowl from one end face of the outer housing body and supported in bearing covers at the end faces of the outer housing body, with the tubular inner bowl having a sound-attenuating effect during operation of the decanter centrifuge and forming a structural unit with the connection ports for discharge of solids and liquids.

According to another feature of the present invention, the connection ports for discharge of solids and liquids are demarcated above the center plane of the housing body by the inner bowl and exhibit a rectangular cross section in an area extending downwards from the center plane in the direction of the assembly opening, whereby end walls bound the connection ports in this area, with each end wall being formed with an opening for passage by the rotor.

Suitably, the connection ports for the discharge of solids and liquids may extend downwards beyond the plane of the lower assembly opening.

BRIEF DESCRIPTION OF THE DRAWING

The above and other objects, features and advantages of the present invention will now be described in more detail with reference to the accompanying drawing, in which.

DETAILED DESCRIPTION OF PREFERRED EMBODIMENTS

Figure 1:
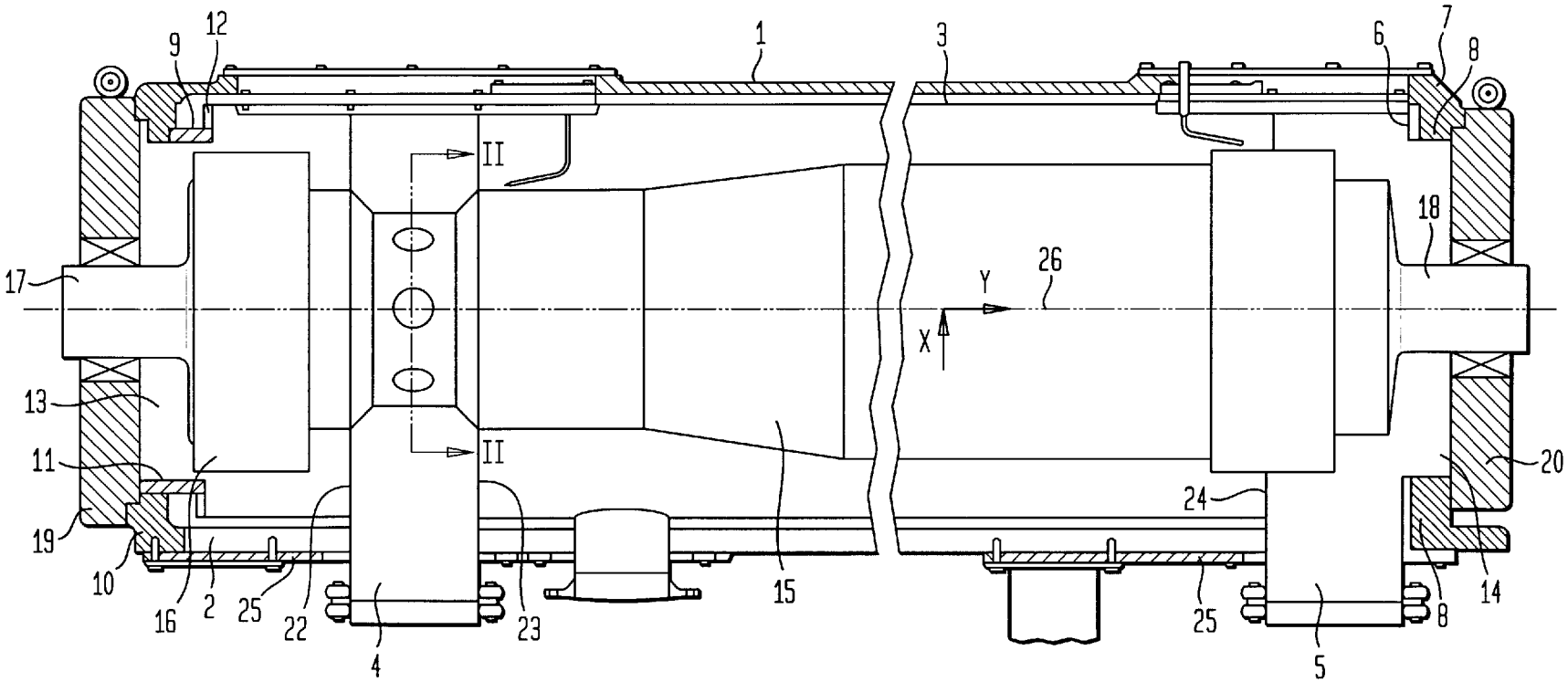
FIG. 1 is a longitudinal sectional view of a horizontal solid-bowl screw decanter centrifuge according to the present invention.

Throughout all the Figures, same or corresponding elements are generally indicated by same reference numerals.

Turning now to the drawing, and in particular to FIG. 1, there is shown a horizontal solid-bowl screw decanter centrifuge according to the present invention, including a self-supporting outer housing body 1 which is of single-piece construction and made of cast iron. The outer housing body 1 is formed with a bottom assembly opening 2 which extends almost over the entire length of the outer housing body 1 and has dimensions that slightly exceed the dimensions of a tubular inner bowl 3 to be installed in the outer housing body 1. The inner bowl 3 may be made of stainless steel and is formed with connection ports 4, 5 for discharge of solids and liquids and has opposite end faces. The connection ports 4, 5 extend radially with respect to a rotation axis 26 of the centrifuge. Formed on one end face of the inner bowl 3 is an inner ring 6, and formed on the other end face of the inner bowl 3 is an inner ring 9.

The structural unit comprised of tubular inner bowl 3 and the ports 4, 5 is inserted through the bottom assembly opening 2 in direction of arrow X into the outer housing body 1 until the longitudinal axis of the outer housing body 1 and the longitudinal axis of the inner bowl 3 coincide or at least substantially coincide. Subsequently, this structural unit is moved in the direction of arrow Y until the inner ring 6 of the inner bowl 3 bears against an end piece 7 of the outer housing body 1. The inner ring 6 is then bolted by screw fasteners 8 to the end piece 7 to secure the inner bowl 3 to the outer housing body 1.

The inner ring 9 at the opposite end face of the housing body 1 is placed through the open end face of the inner bowl 3 before installation of the inner bowl 3 through the assembly opening 2 into the outer housing body 1. Thus, installation of the inner bowl 3 in the direction of arrow X is not disturbed by the presence of the inner ring 9. After securement of the inner ring 6 of the inner bowl 3 to the end piece 7 of the outer housing body 1, the inner ring 9 is pushed against an end piece 10 of the housing body 1 and bolted thereto by screw fasteners 11. Supported by and slidable along the inner ring 9 is a ring 12 positioned on the confronting end face of the inner bowl 3. Thus, expansions of the inner bowl 3 as a result of exposure to heat and contractions of the inner bowl 3 as result of exposure to dropping temperatures can be compensated.

As further shown in FIG. 1, the outer housing body 1 has at its opposite axial ends access openings 13, 14 of sufficient dimensions for insertion of a rotor 15 and a transmission 16 into the interior space of the inner bowl 3. The rotor 15 has journals 17, 18 which are supported by bearing covers 19, 20, respectively, which also close off the access openings 13, 14.

Figure 2:
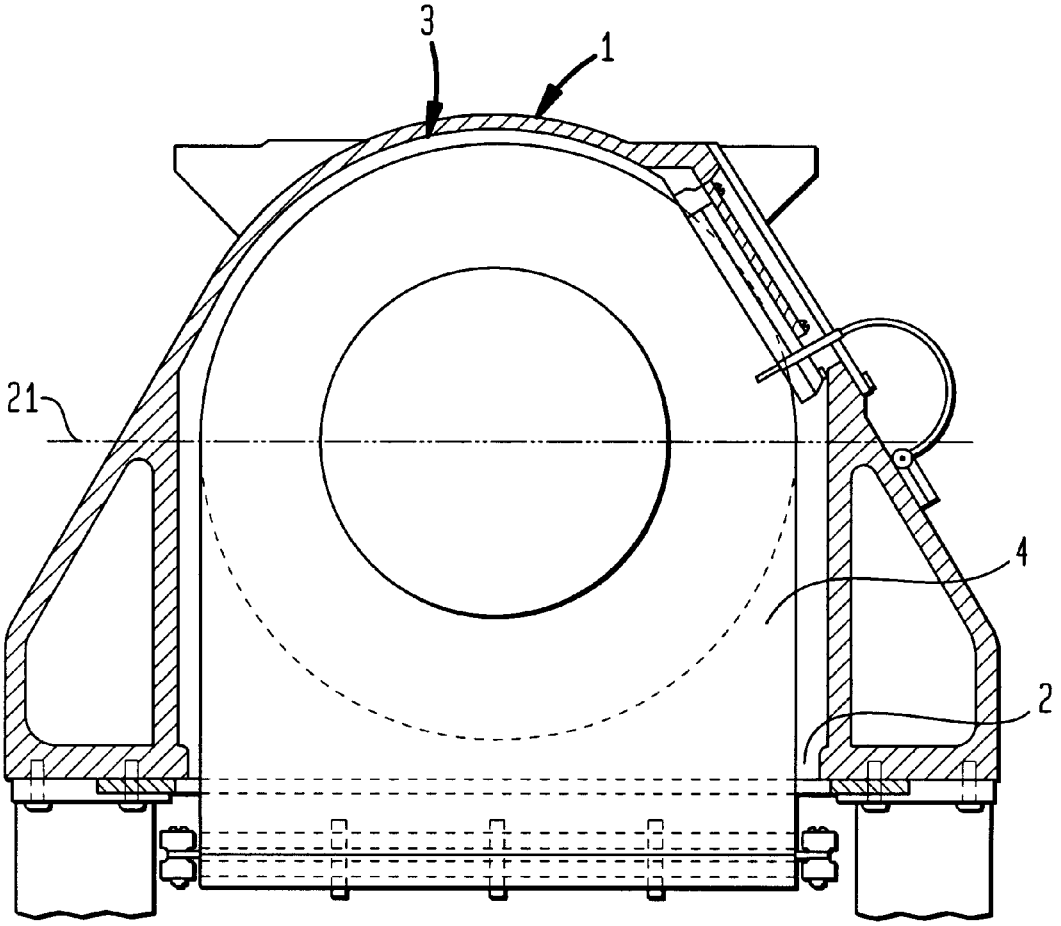
FIG. 2 is a sectional view of the centrifuge, taken along the line II—II in FIG. 1.

As shown in FIG. 2, which is a sectional view of the centrifuge, taken along the line II—II in FIG. 1, the connection ports 4, 5 for discharge of solids and liquids are demarcated above the horizontal center plane 21 by the tubular inner bowl 3 and have in the area from the center plane 21 downwards in the direction of the assembly opening 2 a rectangular cross section. The ports 4, 5 are bounded by end walls 22, 23, 24 which have openings for passage by the rotor 15. FIGS. 1 and 2 also show that the ports 4, 5 extend downwards beyond the plane of the lower assembly opening 2.

After assembly of the centrifuge, the assembly opening 2 is closed by plates 25 in a sound-proof manner.

While the invention has been illustrated and described as embodied in an Improved housing structure for use in a horizontal solid-bowl screw decanter centrifuge, it is not intended to be limited to the details shown since various modifications and structural changes may be made without departing in any way from the spirit of the present invention.

What is claimed as new and desired to be protected by Letters Patent is set forth in the appended claims:

1. A method of assembling a decanter centrifuge, comprising the steps of:

providing an outer housing with a bottom assembly opening;

placing a first mounting ring to one end face of an inner bowl having two opposite end faces and connection ports for discharge of solids and liquids;

inserting the inner bowl in a substantially vertical direction through the assembly opening into the outer housing until a longitudinal axis of the outer housing at least substantially coincides with a longitudinal axis of the inner bowl;

pushing the inner bowl inside the outer housing in a substantially horizontal direction until a second mounting ring on the other end face of the inner bowl bears upon a confronting first end piece of the outer housing;

bolting the second mounting ring to the first end piece;

bolting the first mounting ring to a second end piece of the outer housing; and inserting a unit of rotor and transmission through opposite end faces of the outer housing into an interior space of the inner bowl.

* * * * *